United States Patent [19]

Miller

[11] 4,178,535

[45] Dec. 11, 1979

[54] THREE-WAY BRIGHTNESS FLUORESCENT LAMPHOLDER FITTING

[76] Inventor: Jack V. Miller, 700 N. Auburn Ave., Sierra Madre, Calif. 91024

[21] Appl. No.: 944,389

[22] Filed: Sep. 21, 1978

[51] Int. Cl.[2] ..... H01J 17/34

[52] U.S. Cl. ..... 315/53; 315/54; 315/293; 315/100

[58] Field of Search ..... 315/53, 54, 62, 100, 315/DIG. 4, 293

[56] References Cited

U.S. PATENT DOCUMENTS

| | | | |
|---|---|---|---|
| 2,366,252 | 1/1945 | Geiger | 315/100 |
| 2,504,594 | 4/1950 | Schouwstra et al. | 315/53 |
| 4,105,276 | 9/1978 | Miller | 339/50 C X |

*Primary Examiner*—Alfred E. Smith
*Assistant Examiner*—Charles F. Roberts

[57] ABSTRACT

A fluorescent lampholder fitting has a preheat type circular fluorescent lamp with its ends in proximity and having a first end provided with a starting filament with a first and second filament terminal wire, and a second end provided with a second starting filament with a first and second filament terminal wire. A male screw base electrical connector extends axially along the lamp circle centerline from a housing which supports the lamp in a plane normal to the axis of the screw base. The screw base is provided with three electrical input connections which are adapted to be used in a three-way lampholder of a portable lamp or light fixture. A lamp starter is connected between the first lamp filament and the second lamp filament. A first ballast is connected between a center connection of the screw base and the second lamp filament, and a second ballast is connected between an intermediate ring connection of the screw shell and the second lamp filament; whereby the lamp will start and operate on the first ballast with input power applied to the screw shell and the center connection of the screw base, the second ballast with input power applied to the screw shell and the intermediate ring connection, and both ballasts in parallel with the input power applied to the screw shell and both remaining connections of the screw base.

8 Claims, 3 Drawing Figures

THREE-WAY BRIGHTNESS FLUORESCENT LAMPHOLDER FITTING

BACKGROUND OF THE INVENTION

This invention relates to lighting fixtures, and more particularly to fluorescent lampholder fittings which are adapted to screw into portable lamps and lighting fixtures. Fluorescent lampholder fittings are presently known which screw into various lamp sockets and provide improved illumination with significant reduction in energy consumption.

The most common units on the market at present are single-lamp, single-level devices, or are two-lamps single-level units designed to replace incandescent light bulbs in portable lamps. Since most portable lamps manufactured at present are fitted with three-way lampholders (commonly called sockets), the consumer finds a loss in function if the three-way light bulb is replaced with a fluorescent converter known as a lampholder fitting. In nearly every case the fluorescent lampholder fitting is fitted with circline lamps of either 15 watts or 22 watts, with the greatest use of the 22 watt due to its lumen output being approximately equal to a 75 watt incandescent bulb. Since three-way incandescent bulbs are normally 100 watt or 150 watt devices, lumen equivalence can only be achieved with two fluorescent lamps. Although a two level device may be built using one or two lamps at a time, the three-way performance is still not achieved.

It is known that a fluorescent lamp can be overdriven by supplying higher than rated current, with only a nominal loss is service life. The inventor has constructed units with true three-way function by using a three-way screw base, a first ballast that operates a single lamp with reliable starting at approximately 700 lumens (50 watt incandescent equivalent), a second ballast that operates the lamp at 1200 lumens (more than a 75 watt bulb), and both ballasts in parallel that operate the lamp at 2000 lumens (more than 100 watt incandescent equivalent), and which will function in three-way mode in a standard lamp socket with three-way switch.

BRIEF DESCRIPTION OF THE DRAWINGS

The features of the specific preferred embodiments of the invention are illustrated in the drawings in which.

DETAILED DESCRIPTION OF THE PREFERRED EMBODIMENTS

Figure 1:
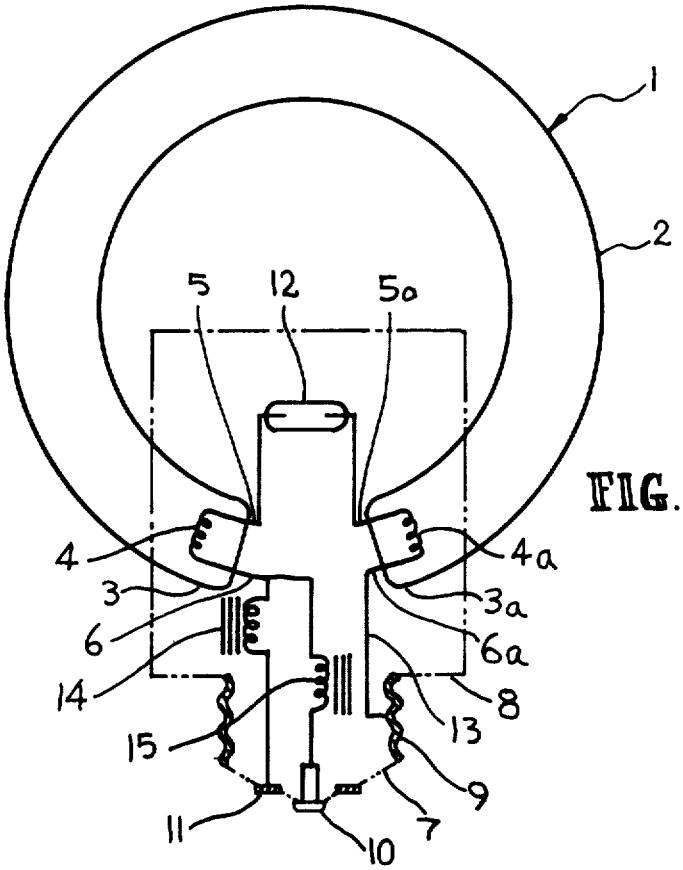
FIG. 1 is a schematic drawing of a three-way brightness fluorescent lampholder fitting employing a circline lamp and using two inductor ballasts.

In FIG. 1 a lampholder fitting 1 is shown having a circline fluorescent lamp 2 with a first end 3 and a second end 3*a* in close proximity. The first end 3 is provided with a filament 4 having a first filament terminal wire 5 and a second filament terminal wire 6 extending therefrom. The second lamp end 3*a* is provided with a filament 4*a* having a first filament terminal wire 5*a* and a second filament terminal wire 6*a* extending therefrom. A male screw base electrical connector 7 is adapted to fit a three-way socket lampholder, and extends from a generally hollow housing 8 which further supports lamp 2. The male screw base is provided with three electrical input connections; a screw shell connection 9, a center connection 10 and an intermediate ring connection 11. A lamp starter 12 is connected between filament terminal wire 5 and filament terminal wire 5*a*. A wire 13 is connected between filament terminal wire 6*a* and the screw shell connection 9 of the male screw base 7. A first inductor ballast 14 is connected between filament terminal wire 6 of lamp end 3 and intermediate ring connection 11 of screw base 7. A secong inductor ballast 15 is connected between filament terminal wire 6*a* of lamp end 3*a* and the center connection 10 of screw base 7. Power applied to connections 9 and 10 will start and operate the lamp with inductor ballast 15, electrical power applied to connections 9 and 11 will start and operate the lamp with inductor ballast 14, and electrical power applied to connection 9 along with connections 10 and 11 in common will start and operate the lamp with inductor ballasts 14 and 15 in parallel. When operated on normally available residential power of 118 volts AC, ballast 15 has a lower current flow than ballast 14, whereby the lamp will operate at a lower brightness on ballast 15 alone, a greater brightness on ballast 14 alone, and a still greater brightness on both ballasts in parallel. Ballast 15 is selected to have a current flow of 150 to 250 milliamperes, which provides acceptable starting and a low lumen level with a 22 watt circline lamp. Ballast 16 is selected to have a current flow of from 250 to 350 milliamperes and a medium lumen level with the same 22 watt lamp. Both ballasts operating in parallel are selected to have a combined current flow of from 400 to 600 milliamperes with the same 22 watt lamp and a high lument output with a reasonable lamp life loss due to overdriving the lamp.

Figure 2:
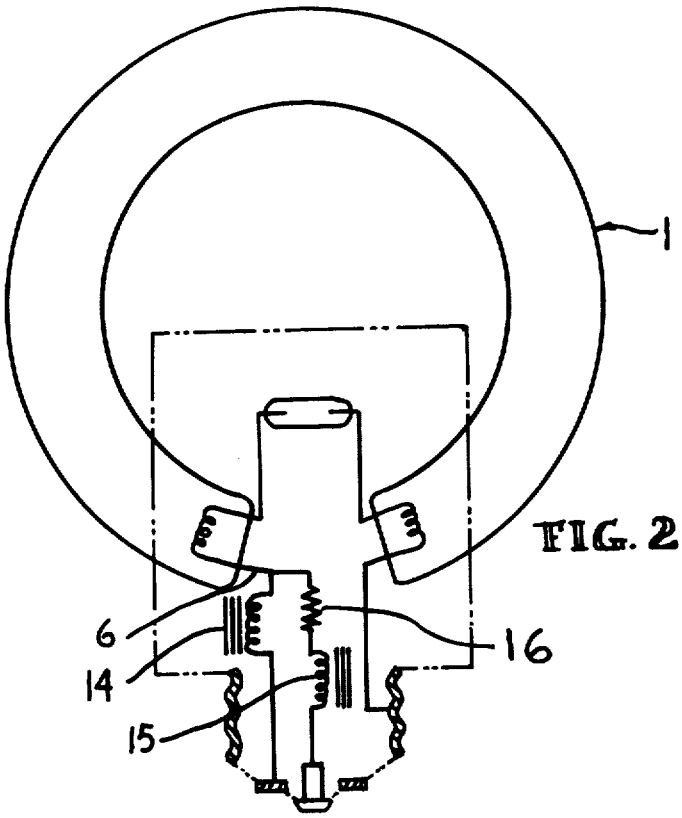
FIG. 2 is a schematic drawing of the lampholder fitting of FIG. 1 and including a resistance in series with one of the inductor ballasts.

In FIG. 2 the lampholder fitting 1 is shown to include a series resistor 16 connected between ballast inductor 15 and the center connection 10 of male screw base 7; and in which the inductances of ballasts 14 and 15 are substantially identical and the impedance of ballast 15 is increased by the addition of resistor 16, thereby reducing the current flow through ballast 15 to less than that of ballast 14.

Figure 3:
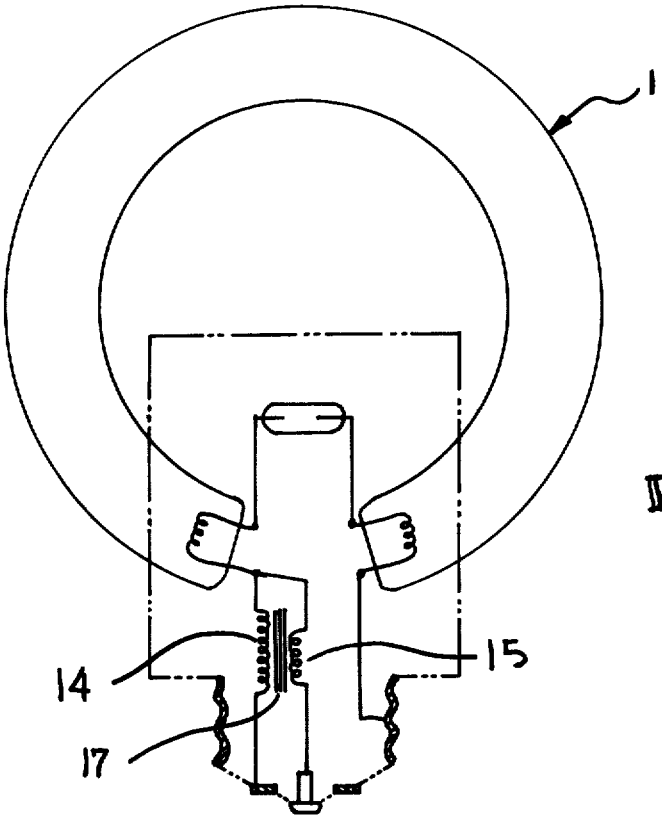
FIG. 3 is a schematic drawing of the lampholder fitting of FIG. 1 wherein the two inductor ballasts share a common core.

In FIG. 3 the lampholder fitting 1 shows the two inductor ballasts 14 and 15 comprise two separate windings on a single common core 17. The two ballast windings may either have dissimilar inductances, as shown in FIG. 1, or may have similar inductances with an added resistance to reduce the impedance of one of the inductors as shown in FIG. 2 or provide comparable lamp life with a slightly larger and higher wattage lamp. Further, the inventor has constructed similar lampholder fittings using straight lamps in a similar manner, and which are as acceptable in certain portable lamp types.

What is claimed is:

1. A fluorescent lampholder fitting comprising:

a fluorescent lamp of preheat type having a first end provided with a starting filament including a first and second terminal wire, and a second end provided with a starting filament including a first and second terminal wire;

a male screw base electrical connector adapted to fit a three-way socket lampholder, said screw base extending from a generally hollow housing which supports the lamp in at least two places and said screw base being provided with three electrical input connections; a screw shell connection, a center connection and an intermediate ring connection;

a lamp starter connected between the first terminal wire of the first lamp end filament and the first terminal wire of the second lamp end filament;

a conductor connecting the screw shell connection of the male screw base to the second terminal wire of the first lamp end filament;

a first ballast means connected between the center connection of the male screw base and the second terminal wire of the second lamp end filament; and a second ballast means connected between the intermediate ring connection of the male screw base and the second terminal wire of the second lamp end filament.

2. A fluorescent lampholder fitting according to claim 1 in which the fluorescent lamp has a nominal rating of from 15 to 25 watts, the first ballast means has a current of no more than 250 miliamperes at 118 volts AC and 60 Hz, and the second ballast means has a current of no less than 250 milliamperes at 118 volts AC and 60 Hz.

3. A fluorescent lampholder fitting according to claim 1 in which the fluorescent lamp is circular and has a diameter of no less than 6 inches and no more than 12 inches.

4. A fluorescent lampholder fitting according to claim 1 in which the ballast means are core-and-coil inductors and the core of at least one of the inductors is disposed no more than one half inch from the glass surface of the fluorescent lamp.

5. A fluorescent lampholder fitting according to claim 1 in which the ballast means are core-and-coil inductors of substantially similar inductance, and at least one of the inductors in connected in series with a resistor.

6. A fluorescent lampholder fitting according to claim 1 in which the ballast means are core-and-coil inductors and one of the inductors has an impedance at least 10% greater than the other inductor.

7. A fluorescent lampholder fitting according to claim 2 in which the lamp is rated at a nominal 22 watts, the first ballast means has a current of 200±50 milliamperes, the second ballast means has a current of 300±50 milliamperes and the two ballasts operating in parallel have a current of 500±100 milliamperes when operating on a supply of nominally 118 volts AC at 60 Hertz.

8. A fluorescent lampholder fitting according to claim 1 in which the first and second ballast means comprise two electrically separate inductor coil windings sharing a common magnetically permeable core.

* * * * *